United States Patent [19]

Tokita et al.

[11] Patent Number: 4,963,786

[45] Date of Patent: Oct. 16, 1990

[54] METHOD AND APPARATUS FOR SUPPORTING A SHADOW MASK

[75] Inventors: Kiyoshi Tokita; Takashi Murai, both of Fukaya; Takeshi Fujiwara, Kumagaya, all of Japan

[73] Assignee: Kabushiki Kaisha Toshiba, Kawasaki, Japan

[21] Appl. No.: 298,973

[22] Filed: Jan. 19, 1989

[30] Foreign Application Priority Data

Jan. 22, 1988 [JP] Japan ..... 63-10797
Aug. 30, 1988 [JP] Japan ..... 63-215740

[51] Int. Cl.[5] ..... H01J 9/18; H01J 29/07

[52] U.S. Cl. ..... 313/406; 313/407; 445/30

[58] Field of Search ..... 313/402, 404, 406, 407; 445/30, 37, 47

[56] References Cited

U.S. PATENT DOCUMENTS 3,334,259 8/1967 Shrader ..... 313/404
4,652,792 3/1987 Tokita et al. ..... 313/404

FOREIGN PATENT DOCUMENTS 62-216137 9/1987 Japan .
62-186348 11/1987 Japan .

*Primary Examiner*—Kenneth Wieder
*Attorney, Agent, or Firm*—Cushman, Darby & Cushman

[57] ABSTRACT

In a color cathode ray tube according to this invention, there are provided a plurality of first elastic supporting members welded to a mask frame to support a shadow mask in a panel and each having a metal plate, and at least one second elastic supporting member each having a metal plate and a washer. The area of a polygon formed on a plane lying at right angles with the tube axis and having apices corresponding to the first elastic supporting members is at least about ½ of the area of the substantial quadrangle formed by projecting the shadow mask on said plane.

12 Claims, 6 Drawing Sheets

METHOD AND APPARATUS FOR SUPPORTING A SHADOW MASK

BACKGROUND OF THE INVENTION

1. Field of the Invention

This invention relates to a color cathode ray tube and, more particularly to a color cathode ray tube having a shadow mask and its manufacturing method.

2. Description of the Related Art

FIG. 1 shows a shadow mask type color cathode ray tube. Color cathode ray tube 1 comprises panel section 6, funnel section 8 and neck section 10, panel section 6 being composed of substantially rectangular faceplate 2 and skirt 4 extending from a peripheral edge of faceplate 2, funnel section 8 being bonded to skirt 4 of panel 6 and neck section 10 being continuous to funnel 8. The inside of cathode ray tube 1 is held airtight by panel 6, funnel 8 and neck 10. Electron gun assembly 11 for emitting electron beams is accommodated in neck 10. Deflection yoke 12 for generating a magnetic field is mounted on the outer surface of funnel 8 and neck 10. Phosphor screen 14 is formed on the inner surface of faceplate 2 of panel 6. Substantially rectangular shadow mask 16 is arranged in tube 1, facing phosphor screen 14 and spaced a specified distance from faceplate 2. Shadow mask 16 is made of a thin metal plate and has formed therein a multitude of slit apertures. Mask frame 18 is provided around shadow mask 16. A plurality of elastically deformable mask supporting members 20 are welded to mask frame 18. A plurality of stud pins 22, which engage with mask supporting members 20, are provided on a peripheral inner surface of skirt 14. Installed on the neck side of mask frame 18 is inner shield 24 to prevent the electron beams from electron gun 11 from being affected by the magnetic field.

In color cathode ray tube 1, the three electron beams emitted from electron gun assembly 11, after deflected by the magnetic field generated by deflection yoke, are converged near shadow mask 16. The converged electron beams land on phosphor screen 14 formed on panel 2. Phosphor screen 14 consists of three kinds of phosphor layers which are arranged in stripes alternately. Those phosphor stripes emit red, green and blue light rays when struck by the corresponding electron beams. Shadow mask 16 is provided such that the three electron beams are incident on the corresponding phosphor stripes.

FIG. 2 shows mask frame 18 mounted on skirt 4 of panel 6. Three mask supporting members **20*a* and one mask supporting member 20*b* are attached near the mid-positions of the four sides of mask frame 18, respectively. Each mask support member 20*a* is composed of bimetal 26 attached to mask frame 18 and metal plate 28 welded to bimetal 26. Mask supporting member 20*b* is composed of bimetal 26, metal plate 28 and washer 30 being in contact with stud pin 22. Mask supporting members 20*a* and 20*b* are engaged with stud pins 22**, respectively.

Mask supporting member **20*a* is shown in FIG. 3A and mask supporting member 20*b* is shown in FIG. 3B. In each mask supporting member 20*a*, metal plate 28 has a hole that catches stud pin 22, the diameter of this hole is equal to a diameter of stud pin 22 of a portion which is to be fitted into the hole for maintaining the specified distance between shadow mask 16 and phosphor screen 14. Also in mask supporting member 20*b*, metal plate 28 has a hole that catches stud pin 22. Washer 30 has a hole and the diameter of this hole is equal to a diameter of stud pin 22 of a portion which is to be fitted into the hole for maintaining the specified distance between shadow mask 16 and phosphor screen 14, and smaller than the hole of plate 28 that catches stud pin 22. That is, the diameter of the hole of plate 28, which catches stud pin 22 is larger than a diameter of stud pin 22 of a portion which is to be fitted into the hole for maintaining the specified distance between shadow mask 16 and phosphor screen 14. Shadow mask 16 is held in tube 1 by the following method. First, the holes of metal plates 28 of only three supporting members 20*a* are fitted onto stud pins 22 and thereby mask frame 18 is temporary held up in panel 6. At mask supporting member 20*b*, stud pin 22 is put into the hole of metal plate 28, but this mask supporting member 20*b* does not contribute to holding of the shadow mask, in other words, maintaining of the specified distance between shadow mask 16 and phosphor screen 14 since the hole diameter is larger than a diameter of stud pin 22 of a portion which is to be fitted into the hole for maintaining the specified distance between shadow mask 16 and phosphor screen 14. Then, washer 30 of mask supporting member 20*b* is inserted between stud pin 22 and metal plate 28. Since the hole diameter of mask supporting member 20*b* is larger than the diameter of the nearest stud pin, mask supporting member 20*b* is movable. Therefore, by moving that peripheral portion of shadow mask 16 which is around mask supporting member 20*b*, the position of shadow mask 16 is adjusted and then, washer 30 is welded to metal plate 28 of mask supporting member 20*b*. Thus, shadow mask 16 is mounted in panel 6** correctly.

However, if shadow mask 16 is mounted to panel 6 by the above method, the area where the correct position of shadow mask 16 with respect to the faceplate is secured by three mask support members **20*a* is very small. In other words, the area of the overlapped portion which the triangle formed on a plane lying at right angles with the tube axis by projecting thereon a triangle having three apexes at three stud pins 22 overlaps with the substantial quadrangle formed on a plane lying at right angles with the tube axis by projecting shadow mask 16 thereon, is about ¼ of the area of the substantial quadrangle. In consequence, if the distance between panel 6 and shadow mask 16 is measured after shadow mask 16 is mounted to panel 16**, there will be a wide area that does not comply with the specification. If a color cathode ray tube is manufactured with such a substandard area present, the result will be a color picture tube of low color purity. Hence, the mass-production aptitude of such color cathode tubes is low. To take an example, if the above-mentioned method of mounting the shadow mask is applied to over 40-inch color cathode ray tubes for high-quality color television sets which are in growing demand, with the screen aspect ratio of 16:9, which is a new standard, the shadow masks are liable to be deformed. This is because in those color cathode ray tubes, the long sides of the mask frames are longer than those of ordinary mask frames. In other words, if the distance between a panel and a shadow mask is adjusted by using supporting members and the shadow mask is mounted to the panel just as in the above method, the shadow mask is likely to suffer torsional deformation. Therefore, it is extremely difficult to make a color cathode ray tube where the distance from the panel complies with the standard across the whole area of the shadow mask.

SUMMARY OF THE INVENTION

The object of this invention is to provide a color cathode ray tube high in color purity and excellent in mass-production aptitude and also provide its manufacturing method.

According to this invention, there is provided a color cathode ray tube comprising: a vacuum envelope with an axis and which has a panel section, a funnel section and a neck section, said panel section being composed of a faceplate, a front view shape of which is substantially rectangular and which has an inner surface, and a skirt with a peripheral portion extending from a peripheral edge of said faceplate, said funnel section being contiguous to said skirt and said neck section being formed in a substantially cylindrical shape and continuous from said funnel; a phosphor screen formed on the inner surface of said faceplate; a shadow mask which is arranged in said panel to oppose said phosphor screen; a mask frame welded to the periphery of said shadow mask; a plurality of stud pins are mounted to said panel to hold said shadow mask. In order to hold said shadow mask in said panel, said mask frame has attached thereto a plurality of elastic supporting means each having a substantially U-shaped metal plate and at least one elastic supporting means having a substantially U-shaped metal plate and a washer.

The area of the polygon formed on a plane lying at right angles with the tube axis by projecting thereon a polygon having its apexes at said stud pins which are engaged respectively with a plurality of elastic supporting means each having only said metal plate is about ½ or more of the area of the substantial quadrangle formed on a plane lying at right angles with the tube axis by projecting thereon the substantial quadrangle of said shadow mask.

In present invention, a color cathode ray tube is assembled by the following method. Said shadow mask is temporarily mounted to the panel by engaging a plurality of the elastic supporting means having the metal plates with the stud pins. After the distance between the shadow mask and the inner surface of the faceplate is adjusted, the elastic supporting means having the metal plate and the washer is engaged with the stud pin and the washer is welded to the metal plate.

According to this invention, a shadow mask can be mounted with its position correctly set with respect to the panel.

DETAILED DESCRIPTION OF THE PREFERRED EMBODIMENTS

Embodiments of this invention will be described below with reference to the accompanying drawings.

Figure 4:
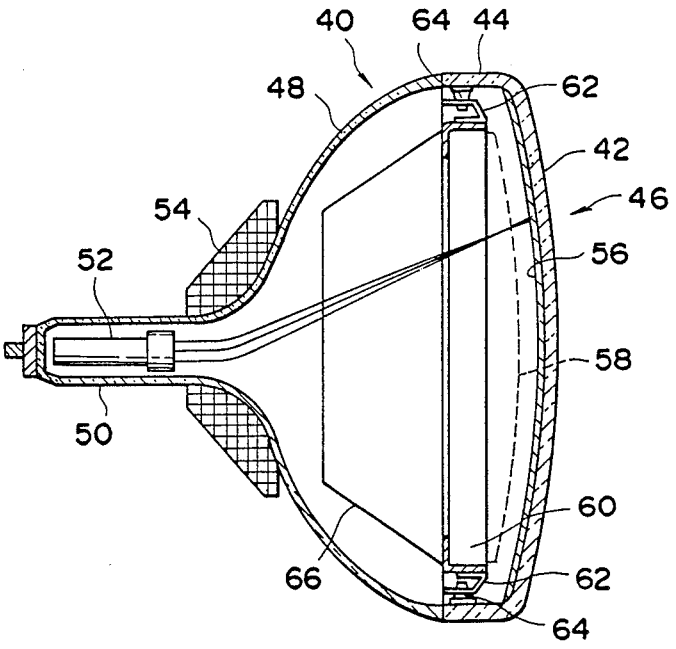
FIG. 4 is longitudinal section showing the construction of an embodiment of the color cathode ray tube according to this invention.

FIG. 4 shows a first embodiment of the color cathode ray tube according to this invention. Color cathode ray tube 40 comprises panel section 46 having substantially rectangular faceplate 42 and skirt 44 extending from the peripheral edge of faceplate 42, funnel section 48 bonded to skirt 44 of panel 46, and neck section 50 continuous to funnel 48. The inside of cathode ray tube 40 is held airtight by panel 46, funnel 48 and neck 50. Accommodated in neck 50 is electron gun assembly 52 for emitting three electron beams. Deflection yoke 54 for generating a magnetic field is mounted on the outer surface of the cathode ray tube and between funnel 48 and neck 50. Phosphor screen 56 is formed on the inner surface of faceplate 42. Phosphor screen 56 is composed of three kinds of phosphor layers which are arranged in stripes alternately. Those phosphor layers emit red, green and blue respectively when struck by the three electron beams. Rectangular shadow mask 58 is arranged in tube 40 to oppose phosphor screen 56. Shadow mask 58 is made of a thin metal plate and has formed therein a multitude of slit apertures. Shadow mask 58 makes the three electron beams from electron gun assembly 52 land on the specified phosphor layers. Mask frame 60 is made of metal and is provided around the periphery of shadow mask 58. A plurality of mask supporting members 62 are elastically deformable and are welded at the corners of frame 60. A plurality of stud pins 64 are engaged with mask supporting members 62 and are provided on a peripheral inner surface of skirt 44. Installed on the neck side of mask frame 60 is inner shield 66 to prevent the electron beams from electron gun 52 from being affected by the magnetic field.

Figure 5:
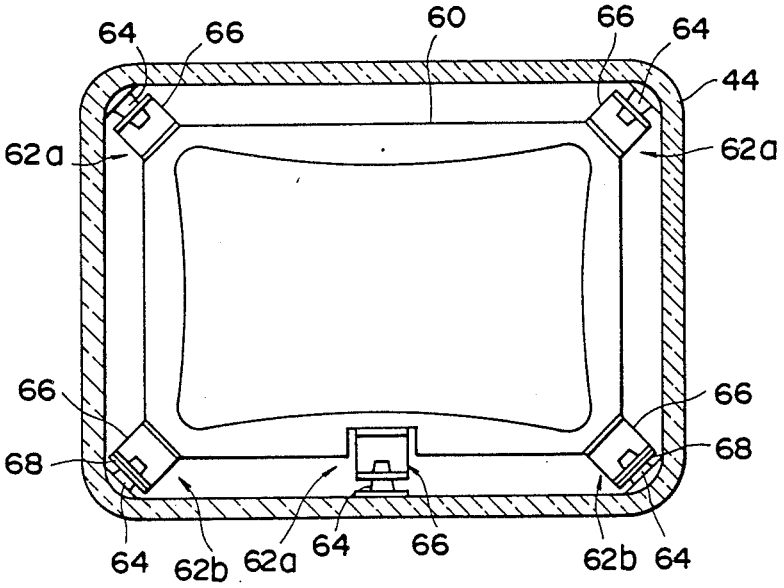
FIG. 5 is a sectional view of an embodiment of the color cathode ray tube according to this invention.
Figure 6A:
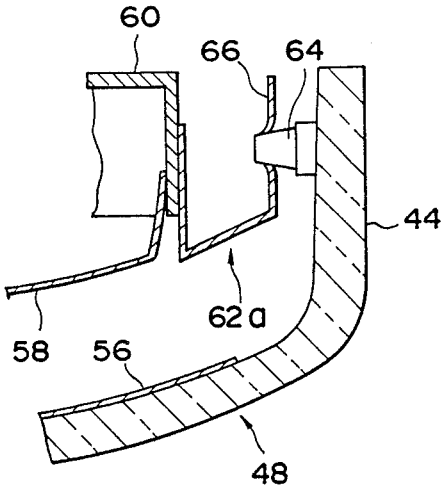
FIG. 6A is a sectional view of an embodiment of an elastic supporting member according to this invention.
Figure 6B:
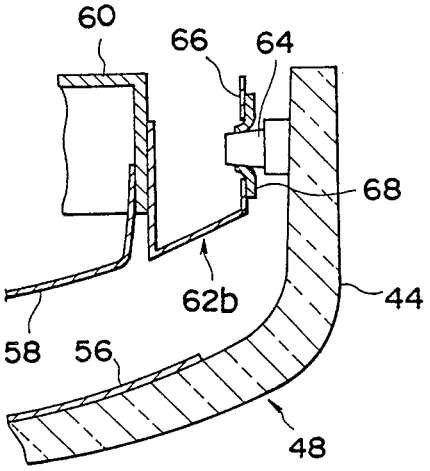
FIG. 6B is a sectional view of an embodiment of an elastic supporting member according to this invention.

FIG. 5 shows a cross section in a plane perpendicular to the axis of said color cathode ray tube. One elastic supporting member **62*a* is provided at the mid-position of one of the long sides of mask frame 60 and two elastic supporting members 62*a* are provided at two corners at the ends of the opposed long side respectively. Two elastic supporting members 62*b* are provided at two other corners of frame 60 respectively. Supporting member 62***a* provided at the mid-position of the long side is fitted in the recess of mask frame 60. Stud pins 64, which are engaged with elastic supporting members 62*a* and 62*b*, are provided on skirt 44. FIG. 6A shows the detailed construction of one of elastic supporting members 62*a*. FIG. 6B shows the detailed construction of one of elastic supporting members 62*b*. Elastic supporting members 62*a* are made of metal plate 66 bent in a substantially U-like configuration in cross section. Metal plates 66 are bored and formed respectively a hole that receives stud pin 64. The diameter of this hole is equal to a diameter of stud pin 64 of a portion which is to be fitted into the hole for maintaining the specified distance between shadow mask 58 and phosphor screen 56. Metal plates 66 of supporting members 62*a* are welded to frame 60. Each elastic supporting member 62*b* has metal plate 66 bent in a U-like configuration and washer 68 having a hole that catches stud pin 64. Each of metal plates 66 is bored and formed a hole into which stud pin 64 is inserted. The diameter of this hole is larger than a diameter of stud pin 64 at the portion which is to be fitted into the hole for maintaining the specified distance between shadow mask 58 and phosphor screen 56. The diameter of the holes bored in washers 68 is equal to a diameter of stud pin 64 of a portion which is to be fitted into the hole for maintaining the specified distance between shadow mask 58 and phosphor screen 56. In elastic supporting members 62*b*, washers 68 are welded to the stud-pin sides of metal plates 66. Therefore, stud pins 64 are fitted into the holes of washers 68 and inserted into the holes of metal plates 66. Metal plates 66 of supporting members 62*b* are welded to mask frame 60. Thus, shadow mask 58 is mounted to panel 48.

Three electron beams are emitted from electron gun assembly 52. The electron beams are deflected by the magnetic field generated by deflection yoke 54. The deflected electron beams are converged at an adjacent portion of shadow mask 58 and are landed on phosphor screen 56 on faceplate 42. As the electron beams scan phosphor screen 56, phosphor screen 56 emits red, green and blue light rays.

In the color cathode ray tube according to this embodiment, a shadow mask is mounted by the following method.

Figure 7A:
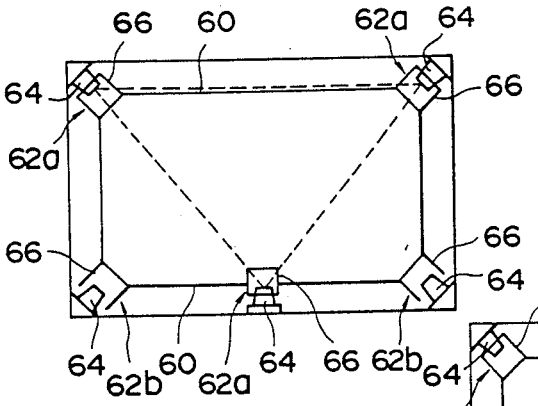
FIG. 7A is a diagram for explaining a mounting method of a shadow mask to a panel according to this invention.
Figure 7B:
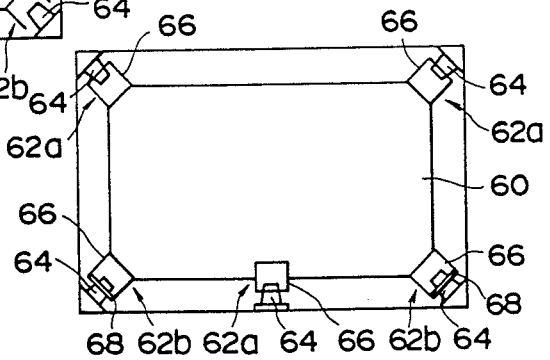
FIG. 7B is a diagram for explaining a mounting method of a shadow mask to a panel according to this invention.

First, one elastic supporting member 62*a* is welded to the recess in the mid-position of a long side of mask frame 60 and two other supporting members 62*a* are welded to the two corners at the ends of the other long side, as shown in FIG. 7A. Two elastic supporting members 62*b*, washers 68 are not mounted, are welded to the remaining two corners respectively. Shadow mask 58 is temporarily mounted to panel 46 as support members 62*a* are engaged with stud pins 64. In supporting members 62*b*, stud pins 64 are inserted into the holes of metal plates 66. However, since the diameter of the holes is larger than the diameter of adjacent stud pins 64, supporting members 62*b* do not contribute to holding of the shadow mask, in other words, maintaining of the specified distance between shadow mask 58 and phosphor screen 56 since the hole diameter is larger than a diameter of stud pin 64 of a portion which is to be fitted into the hole for maintaining the specified distance between shadow mask 58 and phosphor screen 56 in this stage. Then, washers 68 are inserted between metal plates 66 of support members 62*b* and stud pins 64 as shown in FIG. 7B. The diameter of the holes of metal plates 66 of supporting members 62*b* is larger than the diameter of stud pins 64 and, therefore, shadow mask 58 can be moved toward the tube axis. After shadow mask 58 is located in the correct position by adjusting the distance between shadow mask 58 and panel 48, washers 68 are welded to metal plates 66. Thus, shadow mask 58 is fixed in the correct position.

In this embodiment, let us assume a triangle having its apexes at three stud pins 64 with which support members 62*a* are engaged as shown in FIG. 7A. Then, the area of the above-mentioned triangle projected on a plane lying at right angles with the tube axis is about ½ of the area of the area of the substantial quadrangle formed by projecting shadow masks 58 on a plane lying at right angles with the tube axis. In other words, the area of the range where shadow mask 58 spaces out the correct distance from panel 46 when supporting members 62*a* are engaged with stud 64 is about ½ of the whole area of shadow mask 58. Therefore, when a shadow mask is temporarily mounted with some of support members, the area of the range where the shadow mask spaces the correct distance from the panel is wider than the area in the conventional method. Since shadow mask 58, temporarily mounted, has wide area which spaces the correct distance from the panel, the distance can be adjusted with high accuracy for almost the whole area of shadow mask 58 when shadow mask 58 is mounted to panel 46 finally. Therefore, when shadow mask 58 is mounted to panel 46, shadow mask 58 can be arranged and spaced an accurate distance from panel 46.

Figure 8:
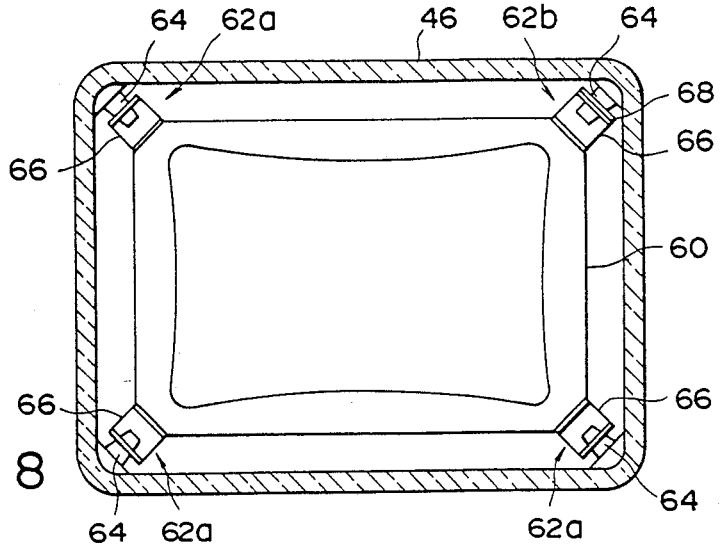
FIG. 8 is a sectional view showing a modification of the embodiment according to this invention.
Figure 9A:
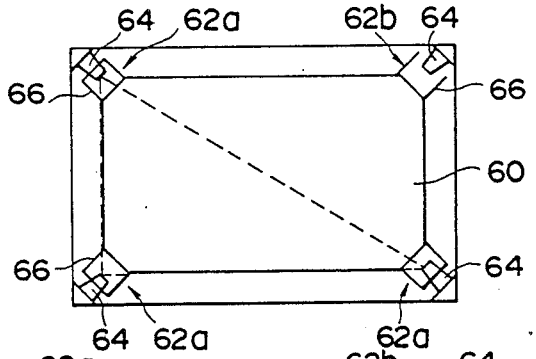
FIG. 9A is a diagram for explaining a mounting method of a shadow mask to a panel in the modification of the embodiment according to this invention.
Figure 9B:
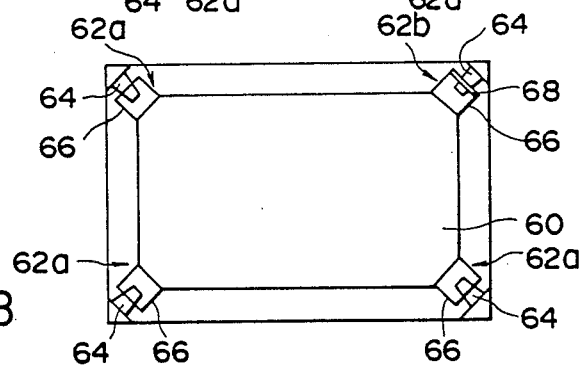
FIG. 9B is a diagram for explaining a mounting method of a shadow mask to a panel in the modification of the embodiment according to this invention.

In the above embodiment, the shadow mask and the mask frame are supported with five elastic supporting members. As a modification of this embodiment, after washers 68 of support members 62*b* are welded to metal plates 66, it is possible to separate one elastic supporting member 62*a* located in the middle of a long side of frame 60. This method may be applied to a case where a shadow mask can be supported sufficiently securely with four elastic supporting members. For example, in small to medium-sized color cathode ray tubes with relatively small screen sizes, four elastic supporting members are enough for supporting a shadow mask. Another modification is shown in FIG. 8. Elastic supporting members 62*a* are welded to three corners of mask frame 60 respectively and elastic support member 62*b* to the remaining one corner. Referring to FIG. 9A, also in this modified embodiment, after mask frame 60 is temporarily mounted to panel 46 by supporting members 62*a* engaged with stud pins 64, stud pin 64 is inserted in the hole of metal plate 66 of support member 62*b*. As shown in FIG. 9B, washer 68 which is engaged with stud pin 64 is inserted between metal plate 66 of support member 62*b* and stud pin 64. After the distance between shadow mask 58 and panel 46 is adjusted, washer 68 of support member 62*b* is welded to metal plate 66. Also in this modification, the area of the triangle formed on a plane lying at right angles with the tube axis by projecting thereon a triangle having its apexes at the three stud pins engaged with support members 62*a* is about ½ of the area of the substantial quadrangle formed on a plane lying at right angles with the tube axis by projecting shadow mask 58 thereon. Consequently, the area of the range where the shadow mask is spaced a correct distance from the panel is wide.

Figure 10:
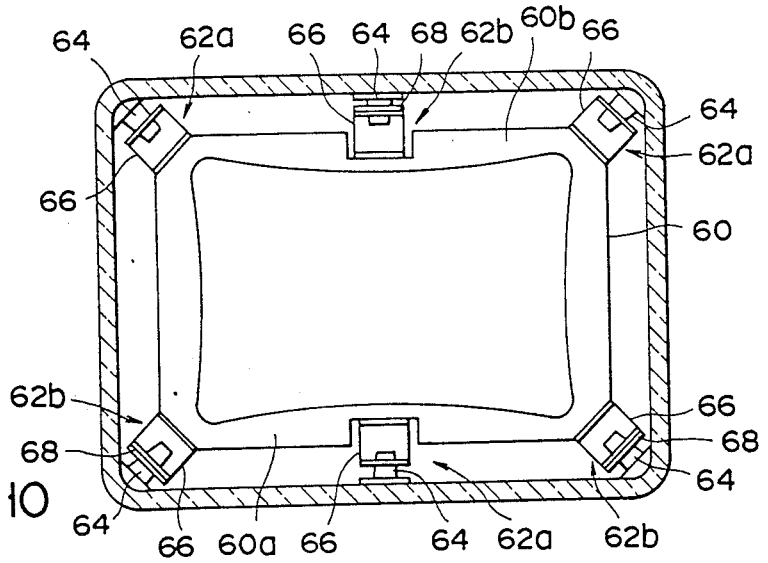
FIG. 10 is a sectional view showing the shadow mask of a second embodiment according to this invention.

Next, a second embodiment will now be described. This embodiment is shown in FIG. 10. In this embodiment, six elastic supporting members are used. Mask frame 60 to which shadow mask 58 is welded has long sides 60a and 60b. A recess for mounting an elastic supporting member is formed in the middle position of each of long sides 60a and 60b. Elastic supporting members 62a are mounted at the two corners of long side 60b and in the middle position of long side 60a. Elastic supporting members 62b are mounted at the two corners of long side 60a and in the middle position of long side 60b. Elastic supporting members 62a are each made of metal plate 66 bent in a substantially U-like configuration. Elastic supporting members 62b are each made of metal plate 66 bent in a substantially U-like configuration and washer 68. Six stud pins 64 to be engaged with the elastic supporting members are mounted on panel 46. Metal plates 66 of support members 62a are formed with a hole whose diameter is equal to a diameter of stud pin 64 at a portion to be fitted into the hole for maintaining the specified distance between shadow mask 58 and phosphor screen 56. Stud pins 64 are fitted into the holes of metal plates 66 of support members 62a. Metal plates 66 of support members 62b are formed with a hole whose diameter is larger than a diameter of stud pin 64 at a portion which is to be fitted into the hole for maintaining the specified distance between shadow mask 58 and phosphor screen 56. Washers 68 are drilled with a hole whose diameter is equal to a diameter of stud pin 64 at a portion to be fitted into the hole for maintaining the specified distance between shadow mask 58 and phosphor screen 56. Stud pins 64 are fitted into the holes of washers 68 and inserted into the holes of metal plates 66. Under the above-mentioned condition, washers 68 are welded to metal plates 66.

Figure 11A:
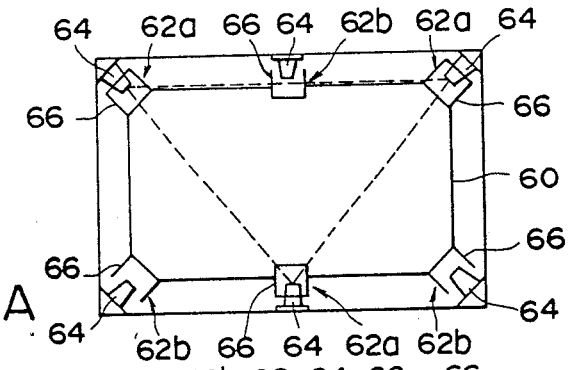
FIG. 11A is a diagram for explaining a mounting method of a shadow mask to a panel of the second embodiment according to this invention.
Figure 11B:
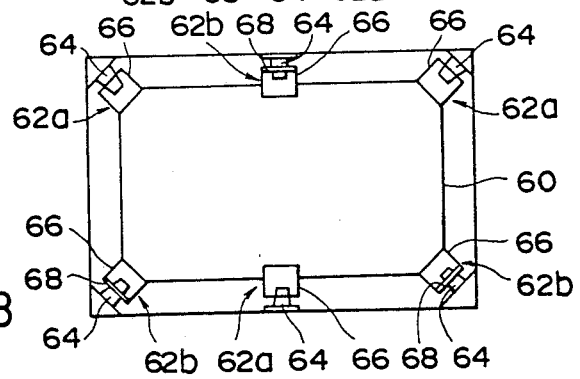
FIG. 11B is a diagram for explaining a mounting method of a shadow mask to a panel of the second embodiment according to this invention.

A shadow mask is mounted to a panel by the following method. As shown in FIG. 11A, shadow mask 58 and mask frame 60 are mounted temporarily to panel 46 as three elastic supporting members 62a are engaged with stud pins 64. In support members 62b, washers 68 are not mounted and metal plates 66 are inserted stud pins 64 into their holes respectively. Then, as shown in FIG. 11B, washers 68 of support members 62b are fitted onto stud pins 64 and inserted between metal plates 66 and stud pins 64. Support members 62b can be moved since the holes of metal plates 66 are larger than stud pins 64. Therefore, the distance between shadow mask 58 and panel 46 is adjusted by the movement of shadow mask 58. After this, washers 68 are welded to metal plates 66. In this way, shadow mask 58 is mounted to panel 46.

In the above embodiment, as shown in FIG. 11A, the area of the triangle formed on a plane lying at right angles with the tube axis by projecting thereon a triangle having its apexes at three stud pins 64 with which support members 62a are engaged is about ½ of the area of the substantial quadrangle formed on a plane lying at right angles with the tube axis by projecting the shadow mask thereon. In other words, the area of the range where shadow mask 58 is spaced the correct distance from panel 46 by support members 62a is about ½ of the whole area of the shadow mask. When a shadow mask is mounted temporarily, the area of the range where the shadow mask 58 spaces the correct distance from panel 46 is wider than in the conventional mounting method. As a result, the shadow mask is arranged very accurately spaced from the faceplate by adjusting the position of the shadow mask. Therefore, a shadow mask can be mounted to a panel with almost the whole area of the shadow mask accurately spaced from the faceplate. This method of supporting a shadow mask with a plurality of elastic supporting members can be applied effectively to e.g., over 40-inch cathode ray tube and color cathode ray tubes for high-quality televisions with a screen aspect ratio of 16:9.

In the above-mentioned embodiment, when a shadow mask is supported on a panel with five or more supporting members, the shadow mask is first mounted temporarily to the panel with three elastic supporting members, that is, one in the middle of one long side of the mask frame and two at the two corners of the other long side of the mask frame. However, the mounting method of a shadow mask is not limited to the above-mentioned embodiment and a shadow mask can be supported by elastic supporting members mounted at the other positions of a mask frame. For example, it is possible to temporarily support a shadow mask on a panel by one elastic supporting member in the middle of a short side of a mask frame and two elastic supporting members at the two corners of the other short side of the mask frame. Further, the arrangement of a support member is not limited to the middle position of a short side but may be somewhere off the middle position of the short side. Also in the above embodiment, three support members are used for temporarily supporting a shadow mask but more than three support members may be used. To be more specific, it is only necessary that the area of the polygon formed on a plane lying at right angles with the tube axis by projecting thereon a polygon having its apexes at the stud pins with which support members are engaged when a shadow mask is supported temporarily, is about ½ or more of the area of the substantial quadrangle formed on a plane lying at right angles with the tube axis by projecting the shadow mask thereon.

Figure 1:
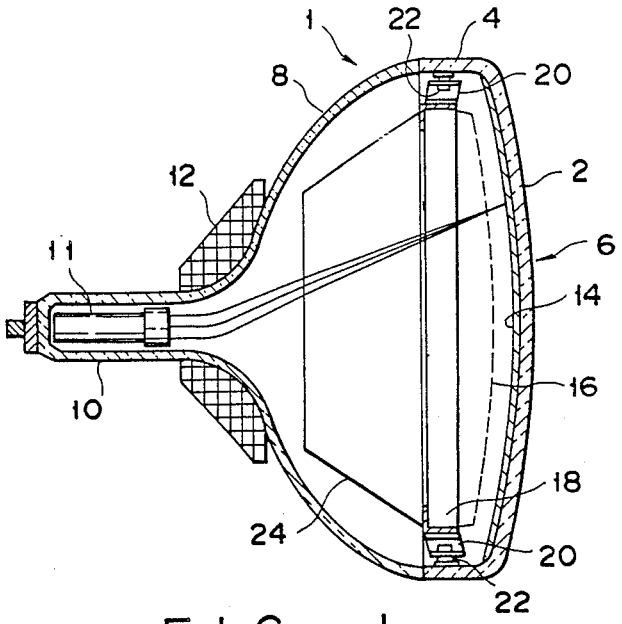
FIG. 1 (PRIOR ART)
FIG. 1 is a longitudinal section showing the construction of a conventional color cathode ray tube.
Figure 2:
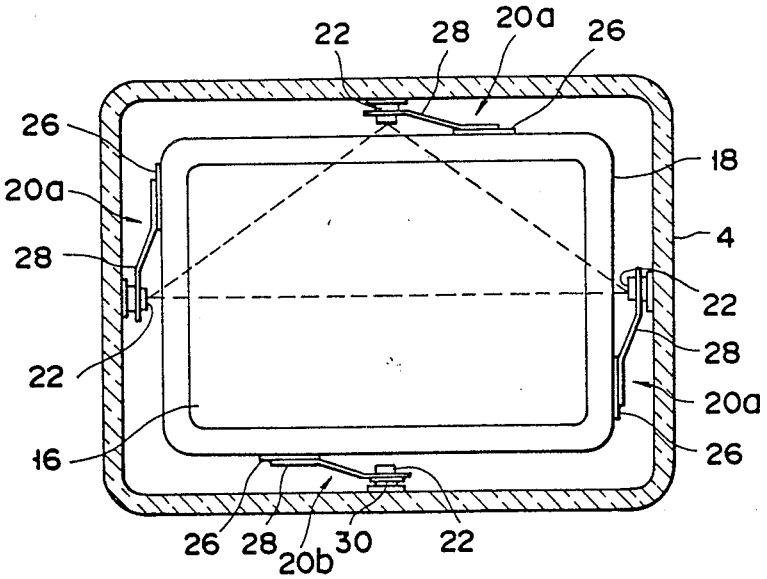
FIG. 2 (PRIOR ART)
FIG. 2 is a sectional view showing a conventional color cathode ray tube.
Figure 3A:
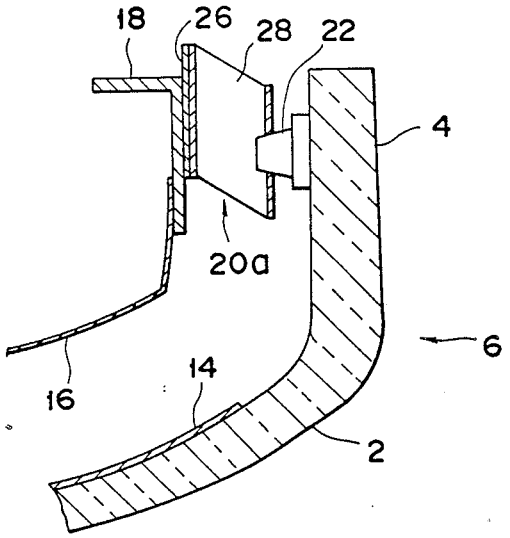
FIG. 3A (PRIOR ART)
FIG. 3A is a sectional view showing a conventional elastic supporting member.
Figure 3B:
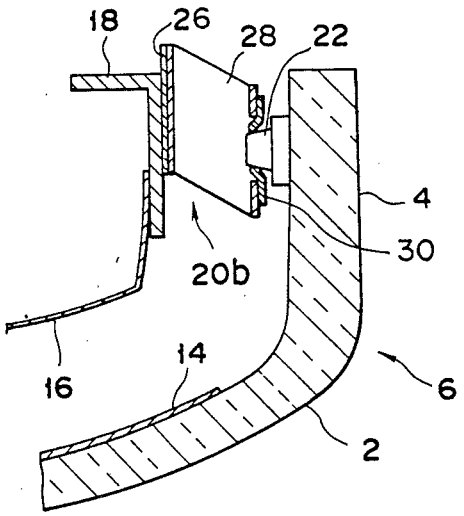
FIG. 3B (PRIOR ART)
FIG. 3B is a sectional view showing a conventional elastic supporting member.

In the above embodiments, elastic supporting members are formed into substantially U-shaped members. However, the form of elastic supporting members is not limited to U-shapes, e.g., conventional elastic supporting members 20 which are formed into plate shape shown in FIG. 2 can be used. It is clear that embodiments with elastic supporting members 20 have the above same effect.

According to this invention, it is possible to provide a color cathode ray tube of improved color purity.

What is claimed is:

1. A color cathode ray tube comprising:

a vacuum envelope defined by a central axis and including a panel section, a funnel section and a neck section, said panel section having a substantially rectangular faceplate with an inner surface, and a skirt extending from a peripheral edge of said faceplate, said funnel section being contiguous to said skirt of said panel section, and said neck section being formed in a substantially cylindrical shape and contiguous with said funnel section;

a phosphor screen formed on said inner surface of said faceplate;

a shadow mask arranged in said panel section and opposite said phosphor screen on said faceplate;

a mask frame welded to a periphery of said shadow mask;

a plurality of stud pins provided on said panel, for supporting said shadow mask;

a plurality of first elastic supporting means for supporting said shadow mask in said panel section, said first supporting means including a metal plate and welded to said mask frame; and at least one second elastic supporting means for supporting said shadow mask in said panel section, said second supporting means having a metal plate and a washer, wherein an area of a polygon formed on a plane lying at right angles with the tube axis and having apices corresponding to said first elastic supporting means is at least about ½ the area of a quadrangle formed by projecting said shadow mask onto a plane lying at right angles with the tube axis.

2. The color cathode ray tube according to claim 1, wherein the washer of said at least one second elastic supporting means is welded to said metal plate and is engaged with said stud pin.

3. The color cathode ray tube according to claim 1, wherein said plurality of first elastic supporting means further comprises three of said first elastic supporting means each having said metal plate, and said at least one second elastic supporting means further comprises two of said second elastic supporting means each having said metal plate and said washer, said first and second elastic supporting means being mounted on said mask frame.

4. The color cathode ray tube according to claim 1, wherein said plurality of first elastic supporting means further comprises three of said first elastic supporting means each having said metal plate, and said at least one second elastic supporting means further comprises one of said second elastic supporting means having said metal plate and said washer, said first and second elastic supporting means being mounted on said mask frame.

5. The color cathode ray tube according to claim 1, wherein said plurality of first elastic supporting means further comprises three of said first elastic supporting means each having said metal plate, and said at least one second elastic supporting means further comprises three of said second elastic supporting means each having said metal plate and said washer, said first and second elastic supporting means being mounted on said mask frame.

6. The color cathode ray tube according to claim 1, wherein said plurality of first elastic supporting means further comprises two of said first elastic supporting means each having said metal plate, and said at least one second elastic supporting means further comprises two of said second elastic supporting means each having said metal plate and said washer, said first and second elastic supporting means being mounted on said mask frame.

7. A method of assembling a color cathode ray tube having a vacuum envelope defined by a central axis and including a panel section, a funnel section and a neck section, a shadow mask opposing said panel section, a mask frame welded to a periphery of said shadow mask, stud pins for supporting said shadow mask in said panel section, a plurality of first elastic supporting means each having a metal plate welded to said frame for supporting said shadow mask in said panel section, and at least one second elastic supporting means each having a metal plate and a washer and welded to said mask frame for supporting said shadow mask in said panel section, comprising the steps of:

first engaging said first elastic supporting means each having said metal plate with said stud pins thereby temporarily supporting said shadow mask in said panel section so that an area of a polygon formed on a plane lying at right angles with the tube axis and having apices corresponding to said plurality of stud pins with which said elastic supporting means are engaged, is at least about ½ of an area of a quadrangle formed by projecting said shadow mask onto a plane lying at right angles with the tube axis; and second engaging at least one of said second elastic supporting means having said metal plate and said washer with the remaining stud pins after said first step has been completed, and adjusting the distance between said shadow mask and said panel section.

8. A method of assembling a color cathode ray tube according to claim 7, wherein said second engaging step comprises the step of welding together said metal plate and said washer of said second elastic supporting means after said distance between said shadow mask and panel section is adjusted.

9. A method of assembling a color cathode ray tube according to claim 7, further comprising the step of separating one of said first elastic supporting means having said metal plate, after said second adjusting step has been completed.

10. A method of assembling a color cathode ray tube according to claim 7, wherein three of said elastic supporting means each having said metal plate and two of said elastic supporting means each having said metal plate and said washer are mounted on said mask frame.

11. A method of assembling a color cathode ray tube according to claim 7, wherein three of said elastic supporting means each having said metal plate and one of said elastic supporting means each having said metal plate and said washer are mounted on said mask frame.

12. A method of assembling a color cathode ray tube according to claim 7, wherein three of said elastic supporting means each having said metal plate and three of said elastic supporting means each having said metal plate and said washer are mounted on said mask frame.

* * * * *